United States Patent [19]

Cairns et al.

[11] Patent Number: 4,713,163

[45] Date of Patent: Dec. 15, 1987

[54] POROUS DIAPHRAGM FOR ELECTROLYTIC CELL

[75] Inventors: John F. Cairns; Gawin W. Cowell, both of Cheshire, England

[73] Assignee: Imperial Chemical Industries PLC, London, England

[21] Appl. No.: 501,764

[22] Filed: Jun. 6, 1983

[30] Foreign Application Priority Data

Jun. 9, 1982 [GB] United Kingdom ..... 8216747

[51] Int. Cl.[4] ..... C25B 1/16

[52] U.S. Cl. ..... 204/296; 427/34

[58] Field of Search ..... 204/98, 252, 295, 296, 204/128; 427/34

[56] References Cited

U.S. PATENT DOCUMENTS

| | | | |
|---|---|---|---|
| 3,909,378 | 9/1975 | Walmsley | 204/98 |
| 4,070,257 | 1/1978 | Motani et al. | 204/98 |
| 4,089,758 | 5/1978 | McAloon | 204/98 |
| 4,151,053 | 4/1979 | Seko et al. | 204/98 |
| 4,169,023 | 9/1979 | Sata et al. | 204/98 |
| 4,189,361 | 2/1980 | Seita et al. | 204/98 |
| 4,189,369 | 2/1980 | Fang | 204/296 |
| 4,250,002 | 2/1981 | Lazarz et al. | 204/98 |
| 4,252,878 | 2/1981 | Lazarz | 429/250 |
| 4,253,923 | 3/1981 | Lynch et al. | 204/98 |
| 4,253,935 | 3/1981 | Simmons | 204/295 |
| 4,316,781 | 2/1982 | Seita et al. | 204/98 |

FOREIGN PATENT DOCUMENTS

| | | |
|---|---|---|
| 0516277 | 10/1976 | Japan . |
| 1081046 | 8/1967 | United Kingdom . |
| 1503915 | 3/1978 | United Kingdom . |
| 1595419 | 8/1981 | United Kingdom. |

*Primary Examiner*—John F. Niebling

*Attorney, Agent, or Firm*—Cushman, Darby & Cushman

[57] ABSTRACT

A diaphragm of a porous sheet of an organic polymer for example, polytetrafluoroethylene, which contains a wetting agent distributed throughout the thickness of the sheet, the concentration of the wetting agent in that part of the sheet near to one or to both outer surfaces of the sheet being greater than the concentration of the wetting agent in that part of the sheet remote from the outer surfaces of the sheet.

17 Claims, No Drawings

POROUS DIAPHRAGM FOR ELECTROLYTIC CELL

This invention relates to a porous diaphragm for an electrolytic cell, and in particular to a porous diaphragm of an organic polymeric material.

Electrolytic cells comprising a plurality of anodes and cathodes separated by porous hydraulically permeable diaphragms which divide the cell into a plurality of anode and cathode compartments have been used for many years for the electrolysis of aqueous solutions of electrolytes. For example, aqueous sodium hydroxide solution and chlorine have been produced on a vast scale for many years by electrolysing aqueous sodium chloride solution in such diaphragm cells in which the porous hydraulically permeable diaphragms are provided by asbestos diaphragms. Where aqueous sodium chloride solution is electrolysed in such an electrolytic cell the solution is charged to the anode compartments of the cell, chlorine which is produced in the electrolysis is removed from the anode compartments, the sodium chloride solution passes through the diaphragms to the cathode compartments of the cell, and hydrogen and sodium hydroxide solution produced by electrolysis are removed from the cathode compartments, the sodium hydroxide being removed in the form of an aqueous solution of sodium hydroxide and sodium chloride.

Although porous hydraulically permeable asbestos diaphragms have been used for many years such diaphragms do suffer from disadvantages. Thus, asbestos diaphragms swell during use which necessitates the use in the cell of an anodecathode gap greater than would otherwise be required, with consequent increase in voltage and power costs. Also asbestos has come under increasing attack in recent years as an environmental hazard. Great care must be exercised in handling asbestos, and care must be taken to remove traces of asbestos from the products of electrolysis.

In recent years it has been proposed to replace asbestos diaphragms in electrolytic cells by diaphragms of synthetic organic polymeric materials. In view of the corrosive environment encountered in many electrolytic cells and particularly in a cell in which an aqueous sodium chloride solution is electrolysed it is necessary to use as a diaphragm a synthetic organic polymeric material which is resistant to degradation in the cell environment. Fluorine-containing polymeric materials have been proposed for use in such diaphragms, for example perfluoro polymeric materials, e.g. polytetrafluoroethylene, as such materials are particularly resistant to degradation in the cell environment.

Examples of porous hydraulically permeable diaphragms of synthetic organic polymeric materials, and methods for producing the diaphragms, are described for example in GB Pat. No. 1503915 in which there is described a porous diaphragm of polytetrafluoroethylene having a microstructure of nodes interconnected by fibrils, in GB Pat. No. 1081046 in which there is described a porous diaphragm produced by extracting a particulate filler from a sheet of polytetrafluoroethylene, and in GB Pat. No. 1522605 in which there is described a diaphragm in the form of a mat of fibrous fluoropolymer which is produced by spinning a dispersion of fluoropolymer into an electric field and collecting the fibres so produced on an electrode in the form of a mat.

All diaphragms of synthetic organic polymeric materials, and particularly diaphragms made of fluorine-containing polymeric materials, e.g. polytetrafluoroethylene, suffer from a fundamental problem in that they may have little if any tendency to be "wetted" by aqueous solutions of electrolytes. Thus, it is difficult to cause aqueous solutions to flow through such diaphragms, and even where the diaphragm is initially permeable to aqueous solution the permeability is not permanent and the diaphragm may become essentially impermeable after electrolysis has been effected for only a short period of time. Various methods have been proposed for overcoming this problem. For example, in GB Pat. No. 1081046 it is proposed to incorporate in the diaphragm a particulate inorganic filler which is chemically inert to the conditions prevailing in the electrolytic cell and which is wetted by the aqueous solution to be electrolysed. Suitable inorganic fillers are barium sulphate, titanium dioxide, and the amphibole and serpentine forms of asbestos. If desired an inorganic filler may be incorporated into the diaphragm after production of the diaphragm, for example by impregnating the diaphragm with a hydrolysable precursor of the filler and subsequently hydrolysing the precursor, as described in GB Pat. No. 1503915.

Other methods of making diaphragms of synthetic organic polymeric materials wettable are described for example in U.S. Pat. No. 4,252,878 in which there is described treating a diaphragm with a solution of a fluorinated surface active agent and drying the thus treated diaphragm, and in Japanese Patent Publication No. 516277 in which a porous diaphragm of a fluorinated resin is treated with a fluorinated surface active agent and then heated at a temperature above the melting point of the resin to bond the surface active agent to the resin. In these methods the pores of the diaphragm are coated with the fluorinated surface active agent throughout the diaphragm.

We have found that even where a diaphragm of a synthetic organic polymeric material incorporates a substance which assists in increasing the permanence of the permeability of the diaphragm to an aqueous solution of an electrolyte the performance of the diaphragm may not be as satisfactory as may be desired. Thus, there may be some loss of the "wetting" substance during use of the diaphragm leading to a progressive decrease in the permeability of the diaphragm to the electrolyte, and in an extreme case the diaphragm may eventually become virtually impermeable to electrolyte. This progressive decrease in permeability may be associated with an increase in voltage of operation of the cell.

The present invention relates to an improved form of diaphragm which is less susceptible than previously proposed diaphragms to progressive decrease in permeability with use in an electrolytic cell. Also, in use an electrolytic cell incorporating the diaphragm is less susceptible to a progressive increase in voltage with increase in the time of operation of the cell.

According to the present invention there is provided a porous sheet diaphragm of an organic polymeric material said sheet containing throughout the thickness of the sheet at least one wetting agent which is a substance capable of increasing the time for which the sheet remains permeable to an aqueous solution of an electrolyte, characterised in that the concentration of the said substance in that part of the sheet near to one or to both outer surfaces of the sheet is greater than the concentration of the said substance in that part of the sheet remote from the outer surfaces of the sheet.

For the sake of simplicity the substance capable of increasing the time for which the sheet remains permeable to an aqueous solution of an electrolyte will hereinafter be referred to as a wetting agent.

When the porous sheet of the present invention is used as a diaphragm in an electrolytic cell the sheet retains an acceptable level of electrolyte permeability for a period of time longer than does a diaphragm in which the concentration of wetting agent in that part of the sheet near to the outer surfaces of the sheet is the same as the concentration in that part of the sheet remote from the outer surfaces of the sheet. Also the voltage of operation of an electrolytic cell is lower where the cell contains a diaphragm of the invention than is the voltage of operation of a cell which contains a diaphragm in which the concentration of wetting agent is the same throughout the thickness of the diaphragm.

The present invention may be applied to a sheet made of any suitable organic polymeric material, and to a porous sheet made by a variety of different methods.

Preferred polymeric materials are fluorine-containing polymeric materials as such materials are generally resistant to degradation by the corrosive environment encountered in many electrolytic cells, for example in cells in which aqueous sodium chloride solution is electrolysed. The polymeric material may be, for example, polytetrafluoroethylene, a tetrafluoroethylenehexafluoropropylene copolymer, a vinylidene fluoride polymer or copolymer, a vinyl fluoride polymer or copolymer, or a fluorinated ethylenepropylene copolymer.

The porous sheet may be made by extraction of a particulate filler from a sheet of organic polymeric material, as described in GB Pat. No. 1081046, by stretching a sheet of polytetrafluoroethylene and thereafter sintering the sheet to produce a porous sheet having a microstructure of nodes interconnected by fibrils, as described in GB Pat. No. 1503915, or by spinning a dispersion of a fluoropolymer in an electric field and collecting the thus formed fibres on an electrode in the form of a mat, as described in GB Pat. No. 1522605. The present invention may be applied to porous diaphragms produced by methods other than those described above. It is not limited in its application to any particular construction of diaphragm not to a diaphragm prepared by any particular method, although a diaphragm produced by the method as described in GB Pat. No. 1503915 is preferred as the diaphragm so produced possesses high strength and a desirable uniformity of pore size.

The diaphragm of the invention is in the form of a sheet and may have a thickness of for example 0.2 mm up to several millimetres, e.g. 5 mm or more. The diaphragm may be a laminate of a plurality of porous sheets. The porosity of the diaphragm may, for example, be in the range of 40% to 90% by volume.

The principle of the present invention is applicable to a diaphragm containing any suitable wetting agent. The wetting agent may, for example, be an organic chemical surface active agent of which a very large number are known in the art. Such surface active agents may be anionic, cationic, non-ionic or amphoteric. In view of the corrosive nature of the environment frequently encountered in electrolytic cells, and particularly in cells in which chlorine and alkali metal hydroxide are produced by electrolysis of alkali metal chloride, it is preferred to use fluorine-containing surface active agents, particularly perfluorinated surface active agents, as such surface active agents are generally more resistant to degradation in such electrolytic cells.

Preferred fluorine-containing surface active agents on account of their thermal stability and resistance to degradation are perfluoroalkyl sulphonic acids, metal salts thereof, and derivatives thereof which may be converted into surface active agents e.g. perfluoroalkyl sulphonyl halides which may be converted into perfluoroalkyl sulphonic acids or metal salts thereof by hydrolysis.

Suitable perfluoroalkyl sulphonic acids and salts include perfluorooctyl sulphonic acid and alkali metal and alkaline earth metal salts thereof, for example sodium, potassium and calcium salts of perfluorooctyl sulphonic acid.

Commercially available surface active agents include those sold under the Fluorad trademark, e.g. FC-134, FC-128, FC-430 and FC-170. Other commercially available surface active agents include those sold under the Zonyl trademark, e.g. Zonyl FSB, Zonyl FSC, Zonyl FSP, and Zonyl FSN.

The wetting agent may be an inorganic material, e.g. a particulate inorganic material. The inorganic material should not be soluble in nor be chemically attacked by the electrolyte nor by the products of electrolysis and it will be chosen bearing in mind the nature of the electrolyte with which the diaphragm is to be used. The wetting agent is suitably an inorganic oxide or hydroxide. Where the diaphragm is to be used in an electrolytic cell for the electrolysis of alkali metal chloride solution preferred particulate inorganic materials include titanium dioxide and zirconium dioxide and hydrated forms thereof. Other suitable inorganic materials include asbestos, barium sulphate, alkaline earth metal titanates, e.g. calcium and barium titanate, alkali metal titanates, e.g. potassium titanate, and silicates, e.g. zirconium silicate.

In the diaphragm of the present invention the wetting agent is distributed throughout the thickness of the diaphragm. Diaphragm containing wetting agents may be produced, for example by forming the diaphragm from a homogeneous mixture of organic polymeric material and wetting agent e.g. from a homogeneous mixture of organic polymeric material and particulate inorganic material or an organic chemical surface active agent. Where the wetting agent is an organic chemical surface active agent it is preferred that the porous diaphragm be heated in the presence of the surface active agent to soften or sinter polymeric material, without destroying the porous structure, in order to assist in fixing the surface active agent to the polymeric material of the diaphragm.

In an alternative method of production, the wetting agent may be incorporated into the diaphragm by contacting an already formed diaphragm with the wetting agent or a precursor therefor. For example, the diaphragm may be contacted with a solution of a surface active agent, or with a dispersion of a particulate inorganic material, or with a solution of a precursor of the inorganic material which precursor may be converted to the inorganic material, e.g. by hydrolysis. In an example of the latter a porous diaphragm may be contacted with a solution of tetrabutyl titanate and the titanate may subsequently be hydrolysed to form a hydrated titanium oxide.

In the diaphragm of the present invention the concentration of wetting agent in that part of the sheet near to one or to both outer surfaces of the sheet is greater than the concentration of the wetting agent in that part of the sheet remote from the outer surfaces of the sheet. The diaphragm of the invention may contain one wetting agent or it may contain two or more wetting agents. For example, a first wetting agent may be present throughout the thickness of the diaphragm and a second and different wetting agent may be present near to one or to both outer surfaces of the sheet such that the concentration of wetting agent, in total, near to one or to both outer surfaces of the sheet is greater than the concentration of the first wetting agent in that part of the sheet remote from the outer surfaces of the sheet.

There are a number of different methods by which this increased concentration of wetting agent may be achieved in that part of the sheet near to one or both outer surfaces of the sheet.

For example, the diaphragm may be produced by lamination of a plurality of sheets containing differing concentrations of wetting agent, the sheets at one or both surfaces of the laminate containing a greater concentration of wetting agent than does the other sheet or sheets, that is the sheet or sheets in the interior of the laminate.

In a further method, which is particularly suitable for use with wetting agents in the form of particulate inorganic materials, the wetting agent may be applied to one or both surfaces of the sheet which already contains wetting agent throughout the thickness of the sheet. The wetting agent may be applied to the outer surface or surfaces of the sheet and a roller may be applied in order to impregnate the wetting agent into the surface or surfaces. For example, the diaphragm may be passed repeatedly through the nip between the rolls of a twin-roll mill and wetting agent may be applied to one surface of the sheet, and if desired subsequently to the other surface of the sheet. During or after application of the wetting agent the polymeric material of the diaphragm may be softened or sintered in order to assist fixing of the wetting agent to the surfaces of the sheet.

The wetting agent may be applied to one or to both surfaces of the sheet by plasma spraying or flame spraying of the wetting agent, particularly where the wetting agent is a particulate inorganic material.

The wetting agent may be applied to one or to both surfaces of a sheet diaphragm in the form of a mixture of polymeric material and wetting agent containing a high proportion of wetting agent. The mixture may be in the form of particles of polymeric material admixed with wetting agent and the polymer may be softened or sintered at least to an extent to fix the polymeric material and wetting agent to the surface(s) of the sheet. The mixture of polymeric material and wetting agent may be in the form of a dispersion or a solution in a liquid diluent and, after application of the dispersion or solution to the surface or surfaces of the diaphragm the liquid diluent may be removed, e.g. by evaporation.

The concentration of wetting agent may be increased in that part of the diaphragm near to one or both surfaces of the sheet by removing polymeric material, in a controlled manner, from the sheet in the region of the surface or surfaces of the sheet. Removal of polymeric material may be effected chemically or by burning.

In the diaphragm of the invention the particular concentrations of wetting agent in that part of the sheet near to one or to both outer surfaces of the sheet, and in that of part of the sheet remote from the outer surfaces of the sheet, is a matter of choice and will depend in part on the nature of the organic polymeric material of the diaphragm and on the porosity of the diaphragm, and on the nature of the wetting agent or agents. For example, where the wetting agent is particulate inorganic material the diaphragm may contain at least 10% by weight, preferably at least 20% by weight, of wetting agent in that part of the sheet remote from the outer surfaces of the sheet, and in that part of the sheet near to one or to both outer surfaces of the sheet the concentration of wetting agent may be at least 10% greater than the concentration of wetting agent in that part of the sheet remote from the outer surfaces of the sheet. The concentration of wetting agent in the former part of the sheet may be as great as 70% by weight, and the outer surface or surfaces of the sheet may comprise as as much as virtually 100% of wetting agent, that is a porous layer of wetting agent.

The diaphragm of the present invention is not limited to use in any particular type of electrolytic cell. It may be used, for example, in an electrolytic cell in which alkali metal hydroxide and chlorine are produced by electrolysis of aqueous alkali metal halide solution. It may be used in electrolytic cells for the electrolysis of other electrolytes, and it may be used as a battery separator.

The invention is now illustrated by the following Examples.

EXAMPLE 1

A porous diaphragm of polytetrafluoroethylene in the form of a 2 mm thick sheet having a porosity of 70% and containing 50% by weight of particulate barium titanate distributed throughout the membrane and having a microstructure of nodes interconnected by fibrils, prepared by stretching a sheet of polytetrafluoroethylene containing barium titanate and sintering the sheet, as described in GB Pat. No. 1503915, was coated on one outer surface with a layer of titanium dioxide by plasma spraying 20 micron particles of titanium dioxide onto the surface. Several sheets of diaphragm thus coated on one surface with titanium dioxide were then installed on the surfaces of a cathode box of an electrolytic cell.

The cathode box was made of mild steel and had four side walls, a woven mesh top surface and a woven mesh bottom surface, and interior woven mesh walls positioned between the top and bottom surfaces so as to form three elongated slots in the box. The sheets of diaphragm were fastened together so as to cover the entire mesh surfaces of the cathode box with the titanium dioxide coated surface of the sheets facing the mesh surfaces.

The thus clad cathode box was positioned on a cell base comprising a titanium base plate and three upstanding bladed anodes the blades of which were coated with a layer of a mixture of 35% by weight $RuO_2$ and 65% by weight of $TiO_2$. The anodes were positioned in the slots of the cathode box, and assembly of the cell was completed by positioning a cell cover on the box. The cell cover was fitted with means for introducing electrolyte into the anode compartment of the cell and with means for removing gaseous products of electrolysis from the cell, and the cathode box was equipped with means for removing gaseous and liquid products of electrolysis from the cathode compartments of the cell.

26% by weight aqueous sodium chloride solution was charged to the anode compartment of the cell and after standing for 3 hours at 85° C. electrolysis of the solution was started at a current density of 2.85 $KA/m^2$ of anode surface. The voltage of operation of the cell at an anode current density of 2.85 $KA/m^2$ and the permeability of the diaphragm were monitored over a period of 6 days, with the following results.

| Days | Voltage Volts | Permeability $hr^{-1}$ |
|---|---|---|
| 0 | 3.27 | 0.161 |
| 1 | 3.27 | 0.155 |
| 2 | 3.26 | 0.157 |
| 3 | 3.26 | 0.147 |
| 4 | 3.26 | 0.147 |
| 5 | 3.26 | 0.142 |
| 6 | 3.26 | 0.139 |

$$\text{Permeability} = \frac{\text{Volume flow rate of electrolyte}}{\text{Diaphragm area} \times \text{Electrolyte head}}$$

By way of comparison the above electrolysis procedure was repeated using a diaphragm which had not been coated on one outer surface with a layer of titanium dioxide. The electrolysis results were as follows:

| Days | Voltage Volts | Permeability $hr^{-1}$ |
|---|---|---|
| 0 | 3.30 | 0.112 |
| 1 | 3.40 | 0.106 |
| 2 | 3.40 | 0.093 |
| 3 | 3.46 | 0.087 |
| 4 | 3.52 | 0.084 |
| 5 | 3.54 | 0.075 |
| 6 | 3.51 | 0.077 |

EXAMPLE 2

A porous diaphragm of polytetrafluoroethylene containing 50% by weight of barium titanate distributed throughout the diaphragm, as used in Example 1, was coated on both outer surfaces with a layer of particulate titanium dioxide by plasma spraying.

The thus coated diaphragm was installed in an electrolytic cell comprising a circular titanium mesh anode, coated with a mixture of 35% by weight $RuO_2$ and 65% by weight of $TiO_2$, and a mild steel mesh cathode.

Aqueous sodium chloride solution was electrolysed under the conditions described in Example 1, and the voltage of operation and the permeability of the diaphragm were monitored over a period of 5 days, with the following results:

| Days | Voltage Volts | Permeability $hr^{-1}$ |
|---|---|---|
| 0 | 3.18 | 0.206 |
| 1 | 3.19 | 0.199 |
| 2 | 3.18 | 0.197 |
| 4 | 3.16 | 0.192 |
| 5 | 3.17 | 0.194 |

EXAMPLE 3

The procedure of Example 2 was repeated except that the diaphragm was coated on one outer surface only with a layer of particulate zirconium dioxide by plasma spraying, the coated surface of the diaphragm facing the cathode.

The voltage of operation and the permeability of the diaphragm were monitored over a period of 6 days with the following results.

| Days | Voltage Volts | Permeability $hr^{-1}$ |
|---|---|---|
| 0 | 3.32 | 0.102 |
| 1 | 3.32 | 0.101 |
| 2 | 3.33 | 0.109 |
| 3 | 3.31 | 0.109 |
| 5 | 3.50 | 0.117 |
| 6 | 3.32 | 0.105 |

EXAMPLES 4 AND 5

In two separate examples porous diaphragms of polytetrafluoroethylene containing 50% by weight of barium titanate distributed throughout the diaphragm, as used in Example 1, were coated on both outer surfaces with a layer of particulate titanium dioxide by plasma spraying (Example 4), and on both outer surfaces with a layer of particulate barium titanate by plasma spraying (Example 5).

The thus coated diaphragms were installed in separate electrolytic cells, each cell comprising a double sided mesh titanium anode coated with a mixture of 35% by weight $RuO_2$ and 65% by weight $TiO_2$ and two mild steel mesh cathodes positioned on either side of the anode. Diaphragms were positioned between each cathode and the anode.

Aqueous sodium chloride solution was electrolysed under the conditions described in Example 1, and the voltages of operation and the permeabilities of the diaphragms were monitored over periods of 5 days and 4 days respectively, with the following results.

EXAMPLE 4

| Days | Voltage Volts | Permeability $hr^{-1}$ |
|---|---|---|
| 0 | 3.44 | 0.279 |
| 1 | 3.47 | 0.268 |
| 2 | 3.47 | 0.272 |
| 3 | 3.48 | 0.260 |
| 4 | 3.48 | 0.262 |
| 5 | 3.46 | 0.258 |

| Days | Voltage Volts | Permeability $hr^{-1}$ |
|---|---|---|
| 0 | 3.23 | 0.648 |
| 1 | 3.23 | 0.630 |
| 2 | 3.26 | 0.625 |
| 3 | 3.29 | 0.617 |
| 4 | 3.29 | 0.604 |

By way of comparison the above electrolysis procedure was repeated with a diaphragm which had not been coated on its outer surfaces.

| Days | Voltage Volts | Permeability $hr^{-1}$ |
|---|---|---|
| 0 | 3.61 | 0.275 |
| 1 | 3.83 | 0.207 |
| 2 | 3.83 | 0.201 |
| 3 | 3.96 | 0.192 |
| 4 | 4.60 | 0.199 |

EXAMPLE 6

50 parts by weight of titanium dioxide powder was added to a dispersion of 15 parts of polytetrafluoroethylene in 35 parts of water and thus formed mixture was sprayed onto one outer surface of a porous diaphragm of polytetrafluoroethylene containing 50% by weight of barium titanate distributed throughout the diaphragm, as used in Example 1.

The thus formed coating on the diaphragm was allowed to dry and the spraying and drying procedure were repeated.

The diaphragm was then heated at a temperature of 325° C. in order to sinter the polytetrafluoroethylene to the surface of the diaphragm.

Two diaphragms prepared as described above were then installed in an electrolytic cell as described in Example 4 with the coated surfaces of the diaphragms facing the cathodes and aqueous sodium chloride solution was electrolysed under the conditions described in Example 1 with the following results:

| Days | Voltage Volts | Permeability $hr^{-1}$ |
|---|---|---|
| 0 | 3.53 | 0.280 |
| 2 | 3.66 | 0.270 |
| 3 | 3.67 | 0.264 |
| 4 | 3.63 | 0.268 |
| 5 | 3.66 | 0.263 |

By way of comparison the above electrolysis procedure was repeated with diaphragms which had not been coated on one of their outer surfaces.

| Days | Voltage Volts | Permeability $hr^{-1}$ |
|---|---|---|
| 0 | 3.51 | 0.361 |
| 1 | 3.64 | 0.270 |
| 2 | 3.64 | 0.242 |
| 3 | 3.74 | 0.218 |
| 4 | 3.75 | 0.190 |
| 5 | 3.83 | 0.164 |

EXAMPLE 7

A porous diaphragm of polytetrafluoroethylene containing 50% by weight of barium titanate distributed throughout the diaphragm, as used in Example 1, was coated on one outer surface with a layer of a solution of sodium in naphthalene ("Tetra-etch"- W L Gore & Associates Inc.) which solution chemically degrades polytetrafluoroethylene. After 2 minutes the solution was washed from the surface with water, the diaphragm was installed in an electrolytic cell of the type described in Example 4 with the untreated surface facing the cathode, and aqueous sodium chloride solution was electrolysed under the conditions described in Example 1, with the following results.

| Days | Voltage Volts | Permeability $hr^{-1}$ |
|---|---|---|
| 0 | 3.74 | 0.199 |
| 1 | 3.76 | 0.193 |
| 2 | 3.77 | 0.187 |
| 3 | 3.77 | 0.180 |
| 4 | 3.76 | 0.185 |

-continued

| Days | Voltage Volts | Permeability $hr^{-1}$ |
|---|---|---|
| 5 | 3.74 | 0.185 |

We claim:

1. A porous sheet diaphragm of an organic polymeric material said sheet containing throughout the thickness of the sheet at least one wetting agent which is a substance capable of increasing the time for which the sheet remains permeable to an aqueous solution of an electrolyte, characterised in that the concentration of the said substance in that part of the sheet near to one or to both outer surfaces of the sheet is greater than the concentration of the said substance in that part of the sheet remote from the outer surfaces of the sheet.

2. A porous diaphragm as claimed in claim 1 characterised in that the organic polymeric material is a fluorine-containing polymeric material.

3. A porous diaphragm as claimed in claim 2 characterised in that the fluorine-containing polymeric material is polytetrafluoroethylene.

4. A porous diaphragm as claimed in any one of claims 1 to 3 characterised in that the diaphragm has a microstructure of nodes interconnected by fibrils.

5. A porous diaphragm as claimed in any one of claims 1 to 3 characterised in that the diaphragm has a porosity in the range 40% to 90% by volume.

6. A porous diaphragm as claimed in claim 1 characterised in that the wetting agent comprises a particulate inorganic material.

7. A diaphragm as claimed in claim 6 characterised in that the wetting agent comprises an inorganic oxide or hydroxide.

8. A diaphragm as claimed in claim 7 characterised in that the wetting agent is selected from titanium dioxide and zirconium dioxide.

9. A diaphragm as claimed in claim 1 characterised in that the wetting agent comprises barium titanate.

10. A diaphragm as claimed in claim 1 characterised in that the diaphragm contains two or more different wetting agents.

11. A diaphragm as claimed in claim 10 characterised in that a first wetting agent is present throughout the thickness of the diaphragm and a second different wetting agent is present near to one or to both outer surfaces of the diaphragm.

12. A diaphragm as claimed in any one of claims 1 to 3 characterised in that the concentration of wetting agent in that part of the diaphragm remote from the surfaces thereof is in the range 10% to 70% by weight.

13. A diaphragm as claimed in any one of claims 1 to 3 characterised in that in that part of the diaphragm near to one or both outer surfaces thereof the concentration of wetting agent is at least 10% greater than the concentration of wetting agent in that part of the diaphragm remote from the outer surfaces thereof.

14. A method of producing a porous sheet diaphragm of an organic polymeric material which sheet contains throughout its thickness at least one wetting agent which is a substance capable of increasing the time for which the sheet remains permeable to an aqueous solution of an electrolyte, the concentration of the said substance in that part of the sheet near to one or to both outer surfaces of the sheet being greater than the concentration of the said substance in that part of the sheet remote from the outer surfaces of the sheet, the method comprising applying wetting agent to one or to both outer surfaces of a sheet which sheet contains wetting agent throughout its thickness.

15. A method as claimed in claim 14 characterised in that the wetting agent is a particulate inorganic material and the wetting agent is applied by plasma spraying.

16. A method as claimed in claim 14 in that the wetting agent is applied to one or to both outer surfaces of the diaphragm in the form of a mixture of wetting agent and organic polymeric material.

17. A method as claimed in claim 16 characterised in that subsequent to application of the mixture the organic polymeric material is softened or sintered.

* * * * *